US010542863B2

(12) United States Patent
Svanbom et al.

(10) Patent No.: US 10,542,863 B2
(45) Date of Patent: Jan. 28, 2020

(54) DISHWASHER AND A METHOD FOR REMOVING WASHING LIQUID FROM A RACK OF A DISHWASHER

(71) Applicant: ELECTROLUX APPLIANCES AKTIEBOLAG, Stockholm (SE)

(72) Inventors: Petter Svanbom, Stockholm (SE); Elianne Lindmark, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 69 days.

(21) Appl. No.: 15/772,231

(22) PCT Filed: Nov. 16, 2015

(86) PCT No.: PCT/EP2015/076698

§ 371 (c)(1),
(2) Date: Apr. 30, 2018

(87) PCT Pub. No.: WO2017/084693

PCT Pub. Date: May 26, 2017

(65) Prior Publication Data

US 2018/0310800 A1 Nov. 1, 2018

(51) Int. Cl.

| | |
|---|---|
| ***A47L 15/48*** | (2006.01) |
| ***A47L 15/22*** | (2006.01) |
| ***A47L 15/00*** | (2006.01) |

(52) U.S. Cl.

CPC ..... *A47L 15/48* (2013.01); *A47L 15/0002* (2013.01); *A47L 15/22* (2013.01); *A47L 2601/20* (2013.01)

(58) Field of Classification Search
None
See application file for complete search history.

(56) References Cited

U.S. PATENT DOCUMENTS

2012/0055517 A1* 3/2012 Yoo ..... A47L 15/0026 134/105

FOREIGN PATENT DOCUMENTS

| | | | | |
|---|---|---|---|---|
| DE | 100 62 885 | A1 | 6/2002 | |
| DE | 10 2007 038673 | B3 | 1/2009 | |
| EP | 1674031 | A1 * | 6/2006 | ..... A47L 15/26 |
| EP | 2 233 057 | A1 | 9/2010 | |
| FR | 2 879 429 | A1 | 6/2006 | |

OTHER PUBLICATIONS

English Machine Translation of EP 1674031.*
International Search Report and Written Opinion for Application No. PCT/EP2015/076698 dated Dec. 22, 2015.

* cited by examiner

*Primary Examiner* — Nicole Blan
(74) *Attorney, Agent, or Firm* — Alston & Bird LLP

(57) ABSTRACT

A dishwasher provided that may include a washing chamber, a rack adapted to accommodate items to be washed by washing liquid within the washing chamber, an arm, and an arm moving arrangement arranged to move the arm within the washing chamber. The arm may include at least one washing liquid removing element arranged to touch at least one of the rack and washing liquid at the rack upon movement of the arm to remove the washing liquid from the rack. The embodiments herein also relate to method for removing washing liquid from a rack of a dishwasher.

14 Claims, 3 Drawing Sheets

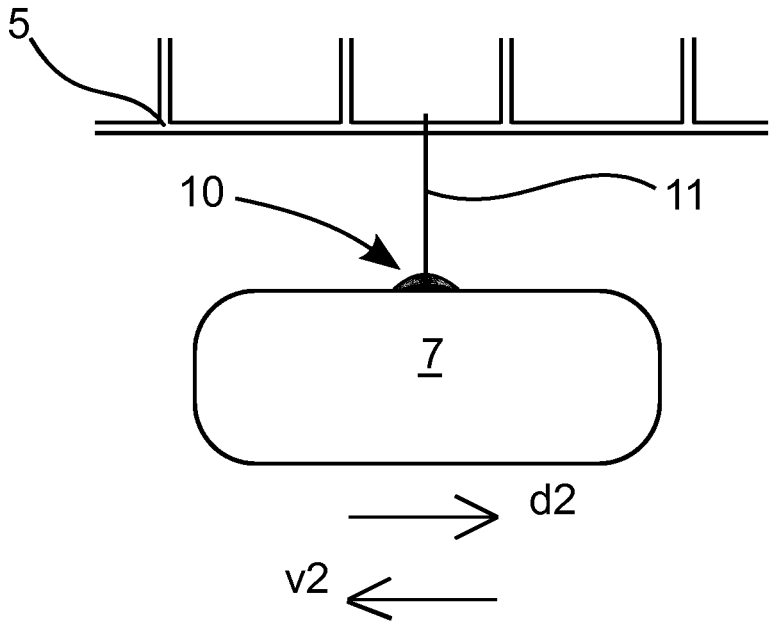
Fig. 2.1
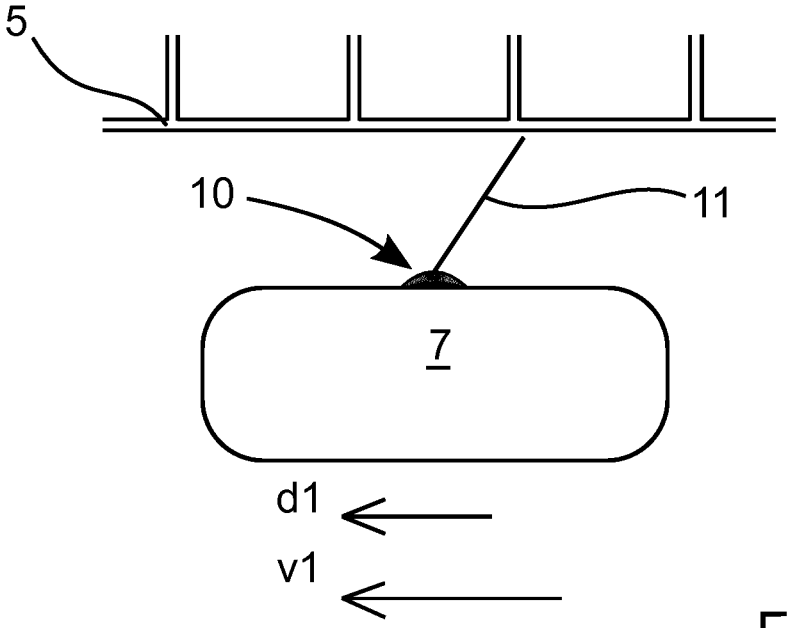
Fig. 2.2

DISHWASHER AND A METHOD FOR REMOVING WASHING LIQUID FROM A RACK OF A DISHWASHER

CROSS-REFERENCE TO RELATED APPLICATIONS

This application is a national stage application filed under 35 U.S.C. § 371 of International Application No. PCT/EP2015/076698 filed Nov. 16, 2015, which application is hereby incorporated by reference in its entirety.

TECHNICAL FIELD

The present disclosure relates to a dishwasher and a method for removing washing liquid from a rack of a dishwasher.

BACKGROUND

Today's dishwashers are expected to perform high quality wash of dishware, and environmental concerns require an efficient use of energy during operation. Also, it is an advantage if washed items are dry after a washing phase. In the last phase of a wash cycle, water is sprayed in to the dishwasher in order to rinse the washed items. After stopping, the remaining water will form drops and pools on the washed items and at the racks. The drops are held on surfaces due to the surface tension in the droplets and are hanging from washed items, racks and places where the washed items and racks meet each other. The water will slowly evaporate and the size of the drops will gradually be reduced. In the last phase of a wash cycle, warm water may be sprayed in to the dishwasher in order to heat the washed items. In addition, modern dishwashers may use heat during a drying phase to dry the washed items, for example by having heaters within the dishwasher and/or by blowing warm air inside the dishwasher. One problem is that the use of heat during a drying phase requires a large amount of energy. Further, such drying process using heat is time consuming.

Attempts have been made to reduce energy consumption during a drying phase of a dishwasher. The document FR2879429 A1 relates to a dishwasher comprising electromechanical vibration generators connected to racks of the dishwasher. The vibration generators generate vibrations that are transmitted to the racks and to the dishware accommodated at the racks in order to remove water droplets from the racks and the dishware. The dishwasher in the document is associated with some problems. One problem is that the vibrations transmitted to the racks will also be transmitted to dishware accommodated in the racks which will cause the dishware to rattle. Obviously, this will generate noise. Further, not all washing liquid will be removed from the racks and the dishware using vibration generators described in the document.

SUMMARY

An object of the embodiments herein is to provide an improved dishwasher that eliminates or at least reduces the problems and/or drawbacks associated with the prior art solutions.

According to an aspect of the invention, the object is achieved by a dishwasher comprising a washing chamber, a rack adapted to accommodate items to be washed by washing liquid within the washing chamber, an arm, and an arm moving arrangement arranged to move the arm within the washing chamber, wherein the arm comprises at least one washing liquid removing element arranged to touch at least one of the rack and washing liquid at the rack upon movement of the arm, to remove the washing liquid from the rack.

Since the arm comprises at least one washing liquid removing element arranged to touch at least one of the rack and washing liquid at the rack upon movement of the arm, the washing liquid at the rack, will be removed simply by touching at least one of the rack and washing liquid at the rack by the at least one washing liquid removing element. In addition, since the rack is adapted to accommodate items to be washed by washing liquid, the at least one washing liquid removing element may also touch the items to be washed by washing liquid. As a result, the washing liquid will be removed from the rack and/or from the items to be washed in a simple and an efficient manner. Thus, during a drying phase of the dishwasher, less time and energy is required in order to evaporate washing liquid, since there is less washing liquid to evaporate. Further, the washing liquid will be effectively removed without the need of vibrating of the racks of the dishwasher. Thereby, less noise will be generated than the above described solution. Accordingly, an improved dishwasher is provided.

As a result, the above mentioned object is achieved.

Optionally, the arm is a wash arm provided with at least one spray nozzle for spraying washing liquid into the washing chamber to wash the items to be washed by the washing liquid. Thereby, an already existing wash arm of the dishwasher comprises the at least one washing liquid removing element. As a result, the washing liquid may be removed in a simple and efficient manner while production cost of the dishwasher provided may be kept low.

Optionally, the movement is a rotational movement. Thereby, the arm may be moved in a simple manner.

Optionally, the arm moving arrangement comprises a motor arranged to move the arm.

Since the arm moving arrangement comprises a motor arranged to move the arm, the movement of the arm may be controlled in a simple manner. In addition, the arm may be moved in a predetermined manner to ensure an effective removing of the washing liquid from the rack. Further, the arm may be moved without need for water or air to be sprayed through the spray nozzles.

Optionally, the at least one washing liquid removing element is resilient. Thereby, the at least one washing liquid removing element may touch at least one of the rack and washing liquid at the rack in a smooth manner upon movement of the arm. Since the at least one washing liquid removing element may touch at least one of the rack and washing liquid at the rack in a smooth manner, resistance forces between the at least one washing liquid removing element and the rack may further be reduced. As a result, vibrations and noise may be further circumvented.

Optionally, the arm moving arrangement is arranged to move the arm during at least a drying phase of the dishwasher. Thus, the washing liquid may be removed from the rack and/or from the items to be washed in a simple and an efficient manner during at least the drying phase of the dishwasher, which will shorten the drying process of the dishwasher.

Optionally, the at least one washing liquid removing element is arranged to touch at least one of the rack and the washing liquid at the rack only during the drying phase. Since the at least one washing liquid removing element is arranged to touch at least one of the rack and the washing liquid at the rack only during the drying phase, the at least one washing liquid removing element is arranged to cease from touching at least one of the rack and the washing liquid at the rack during a washing phase of the dishwasher. Thereby, resistance forces between the at least one washing liquid removing element and the rack during the washing phase will be eliminated. Further, noise caused by the at least one washing liquid removing element touching at least one of the rack and the washing liquid at the rack during the washing phase will be circumvented. Even further, wear and tear of the at least one washing liquid removing element is reduced.

Optionally, the arm is a wash arm, and wherein the arm moving arrangement is arranged to move the arm in a first direction during a washing phase, and in a second direction during a drying phase of the dishwasher, wherein the first direction is opposite to the second direction, and wherein the at least one washing liquid removing element is arranged to touch at least one of the rack and the washing liquid at the rack upon movement of the arm in the second direction, and wherein the at least one washing liquid removing element is arranged to be at least one of deformed and displaced during movement of the arm in the first direction, and is arranged to cease from touching at least one of the rack and the washing liquid at the rack upon being at least one of deformed and displaced during movement of the arm in the first direction. Thereby, resistance forces between the at least one washing liquid removing element and the rack during the washing phase are eliminated in a simple manner by moving the arm in the first direction during the washing phase. Likewise, washing liquid is effectively removed from the rack in a simple manner by moving the arm in the second direction during the drying phase. Further, noise caused by the at least one element touching at least one of the rack and the washing liquid at the rack during the washing phase is circumvented in a simple manner. Even further, wear and tear of the at least one washing liquid removing element is reduced in a simple manner. As a result, an improved dishwasher is provided.

Optionally, the arm is a wash arm, and the arm moving arrangement is arranged to move the arm at a first velocity during a washing phase and at a second velocity during a drying phase of the dishwasher, wherein the first velocity is higher than the second velocity, and wherein the at least one washing liquid removing element is arranged to touch at least one of the rack and the washing liquid at the rack upon movement of the arm at the second velocity, and wherein the at least one washing liquid removing element is arranged to be at least one of deformed and displaced during movement of the arm at the first velocity, and is arranged to cease from touching at least one of the rack and the washing liquid at the rack upon being at least one of deformed and displaced during movement of the arm at the first velocity. Thereby, resistance forces between the at least one washing liquid removing element and the rack during the washing phase are eliminated in a simple manner by moving the arm at the first velocity during the washing phase. Likewise, washing liquid is effectively removed from the rack in a simple manner by moving the arm at the second velocity during the drying phase. Further, noise caused by the at least one element touching at least one of the rack and the washing liquid at the rack during the washing phase is circumvented in a simple manner. Even further, wear and tear of the at least one washing liquid removing element is reduced in a simple manner. As a result, an improved dishwasher is provided.

Optionally, the at least one washing liquid removing element comprises a non-absorbing material Since the at least one washing liquid removing element comprises a non-absorbing material, the at least one washing liquid removing element will wipe the washing liquid from the rack, rather than absorbing it. As a result, a greater amount of washing liquid will end up at a bottom of the dishwasher wherefrom the washing liquid efficiently may be transported away from the dishwasher, for example by a pump to a drain. Further, since the at least one washing liquid removing element comprises a non-absorbing material, it will not hold washing liquid after use which may prolong the lifespan of the at least one washing liquid removing element.

Optionally, the arm comprises a plurality of washing liquid removing elements arranged to touch at least one of the rack and the washing liquid at the rack upon movement of the arm to remove washing liquid from the rack. Thereby, an even more efficient removing of washing liquid is provided.

Further embodiments herein aim to provide an improved method for removing liquid from a rack of a dishwasher, eliminating or at least reducing the problems and/or drawbacks associated with prior art solutions.

According to some embodiments, this is provided by a method for removing washing liquid from a rack of a dishwasher comprising a washing chamber, a rack adapted to accommodate items to be washed by washing liquid within the washing chamber, an arm and an arm moving arrangement, wherein the arm comprises at least one washing liquid removing element and wherein the method comprises:

moving the arm within the washing chamber, using the arm moving arrangement, and removing washing liquid from the rack by touching at least one of the rack and washing liquid at the rack upon the movement of the arm, using the at least one washing liquid removing element.

Since, the method comprises removing washing liquid from the rack by touching at least one of the rack and washing liquid at the rack upon the movement of the arm, using the at least one washing liquid removing element, the washing liquid will be effectively removed which will shorten a drying process of the dishwasher. Thus, the time and the energy needed to evaporate the washing liquid will be reduced. Further, the washing liquid will be effectively removed without need of vibrating of the racks of the dishwasher. Thereby, less noise will be produced than according to prior art solutions. Accordingly, an improved method for removing liquid from a rack of a dishwasher is provided.

Accordingly, a method for removing liquid from a rack of a dishwasher is provided which eliminates or at least reduces the problems and/or drawbacks associated with prior art solutions.

As a result, the above mentioned object is achieved.

Optionally, the arm is a wash arm and the method may comprise:

moving the arm in a first direction during a washing phase of the dishwasher, using the arm moving arrangement, wherein the at least one washing liquid removing element is arranged to be at least one of deformed and displaced during movement of the arm in the first direction, and wherein the at least one washing liquid removing element is arranged to cease from touching at least one of the rack and the washing liquid at the rack upon being at least one of deformed and displaced during movement of the arm in the first direction, moving the arm in a second direction during a drying phase of the dishwasher, using the arm moving arrangement, wherein the first direction is opposite to the second direction, and removing the washing liquid from the rack by touching at least one of the rack and washing liquid at the rack upon movement of the arm in the second direction.

Thereby, resistance forces between the at least one washing liquid removing element and the rack during the washing phase is eliminated in a simple manner by moving the arm in the first direction during the washing phase. Since the resistance forces between the at least one washing liquid removing element and the rack during the washing phase are eliminated, also noise caused by the at least one element touching at least one of the rack and the washing liquid at the rack during the washing phase is circumvented in a simple manner by moving the arm in the first direction. In addition, wear and tear of the at least one washing liquid removing element is reduced in a simple manner.

Further, washing liquid can be effectively removed from the rack simply by moving the arm in the second direction during the drying phase of the dishwasher. Thereby, an improved method for removing washing liquid is provided.

Optionally, the arm is a wash arm and the method may comprise:

moving the arm at a first velocity during a washing phase of the dishwasher, using the arm moving arrangement, wherein the at least one washing liquid removing element is arranged to be at least one of deformed and displaced during movement of the arm at the first velocity, and wherein the at least one washing liquid removing element is arranged to cease from touching at least one of the rack and the washing liquid at the rack upon being at least one of deformed and displaced during movement of the arm at the first velocity, moving the arm at a second velocity during a drying phase of the dishwasher, using the arm moving arrangement, wherein the first velocity is higher than the second velocity, and removing the washing liquid from the rack by touching at least one of the rack and washing liquid at the rack upon movement of the arm at the second velocity.

Thereby resistance forces between the at least one washing liquid removing element and the rack during the washing phase are eliminated in a simple manner by moving the arm at the first velocity during the washing phase. Since the resistance forces between the at least one washing liquid removing element and the rack during the washing phase are eliminated, also noise caused by the at least one element touching at least one of the rack and the washing liquid at the rack during the washing phase is circumvented in a simple manner by moving the arm at the first velocity.

Further, washing liquid will be effectively removed from the rack simply by moving the arm at the second velocity during the drying phase of the dishwasher. Thereby, an improved method for removing washing liquid is provided.

Further features of, and advantages with, the present invention will become apparent when studying the appended claims and the following detailed description. Those skilled in the art will realize that the different features described may be combined to create embodiments other than those described in the following, without departing from the scope of the present invention, as defined by the appended claims.

BRIEF DESCRIPTION OF THE DRAWINGS

The various aspects of the invention, including its particular features and advantages, will be readily understood from the following detailed description and the accompanying drawings, in which;

FIG. 2.1 and FIG. 2.2 illustrate a respective cross section of a rack, an arm and a washing liquid removing element according to some embodiments of the dishwasher illustrated in FIG. 1.

DETAILED DESCRIPTION

The embodiments herein will now be described more fully with reference to the accompanying drawings. Like numbers refer to like elements throughout.

Figure 1:
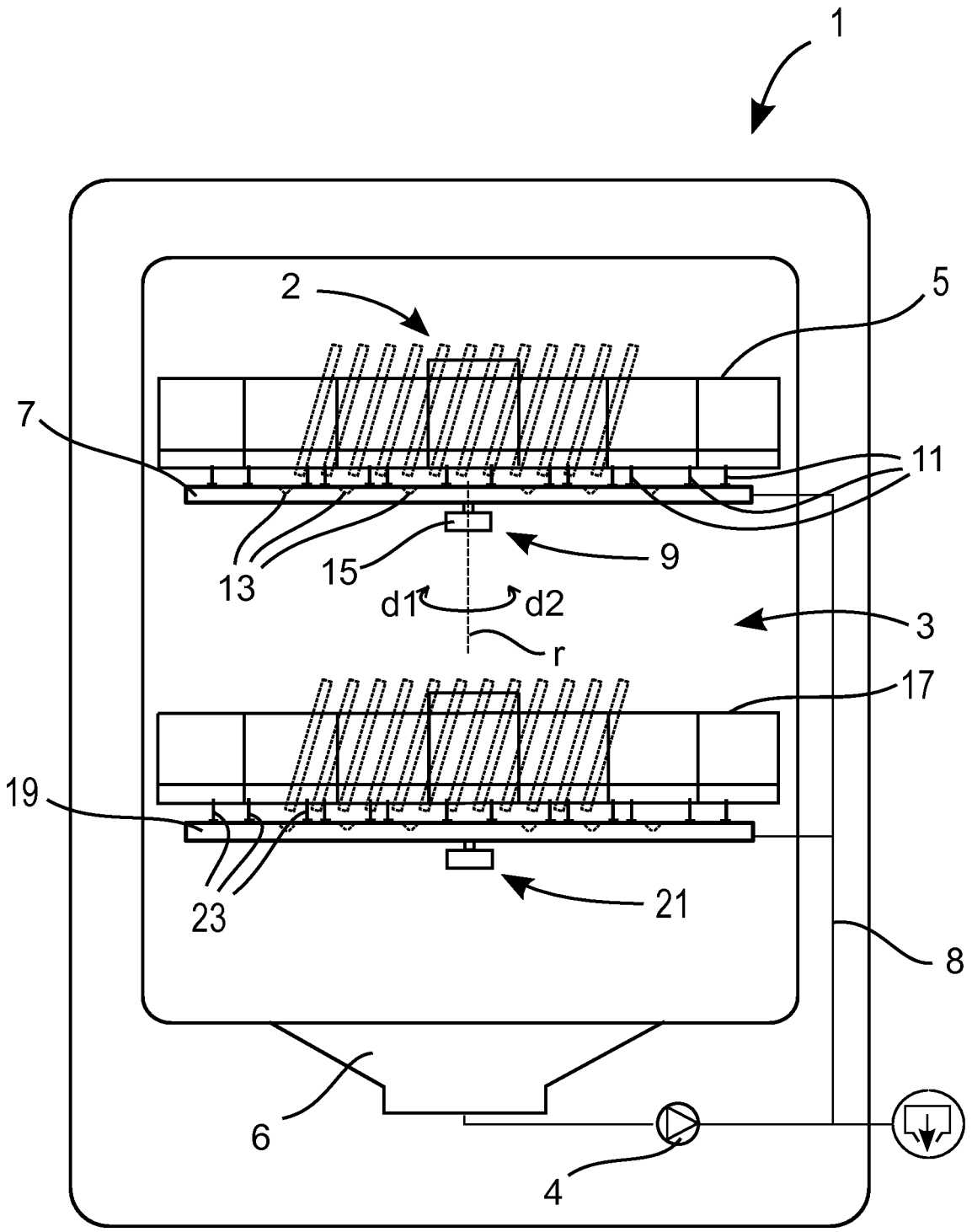
FIG. 1 illustrates a dishwasher according to some embodiments.

FIG. 1 illustrates a dishwasher 1 comprising a washing chamber 3, a rack 5 adapted to accommodate items 2 to be washed by washing liquid within the washing chamber 3, an arm 7, and an arm moving arrangement 9 arranged to move the arm 7 within the washing chamber 3. As illustrated in FIG. 1, the arm 7 comprises at least one washing liquid removing element 11 arranged to touch at least one of the rack 5 and washing liquid at the rack 5 upon movement of the arm 7, to remove the washing liquid from the rack 5. Thereby, the washing liquid at the rack 5 will effectively be removed. As a result, a drying process of the dishwasher can be shortened since the time and the energy needed to evaporate the washing liquid during such drying phase will be reduced.

According to the embodiments illustrated in FIG. 1, the dishwasher 1 is configured to perform a washing phase for washing the items 2, and a drying phase for drying the items 2. When starting the washing phase, the washing liquid is delivered to the dishwasher 1 to be warmed up and then sprayed into the washing chamber 3. The washing liquid used during the washing phase is collected at the bottom 6 of the dishwasher 1 and then pumped to the arm 7 using a washing liquid pump 4 and ducts 8. When the washing phase is finished, the washing liquid is pumped out from the dishwasher to a drain. After the washing phase, some of the washing liquid may still remain within the washing chamber 3 in the form of drops and pools at the rack 5 and at the items 2. The drops will remain at the rack 5 and at the items 2 due to surface tension of the drops. Since the at least one washing liquid removing element 11 is arranged to touch at least one of the rack 5 and washing liquid at the rack 5 upon movement of the arm 7, such drops are effectively removed from the rack 5. After being removed, the washing liquid can be collected at the bottom 6 of the dishwasher 1 and then pumped to a drain using the washing liquid pump 4. As a result, energy needed to evaporate the washing liquid will be reduced, and the drying process of the dishwasher 1 can be shortened, since there is less washing liquid to evaporate.

According to the embodiments illustrated in FIG. 1, the arm 7 is a wash arm provided with at least one spray nozzle 13 for spraying the washing liquid into the washing chamber 3 to wash the items 2 to be washed by the washing liquid. The arm 7 may be arranged below the rack 5 at a distance enabling an effective washing of items 2 accommodated in the rack 5. The washing of the items 2 is performed by spraying washing liquid into the washing chamber 3 through the least one spray nozzle 13 to wash the items 2 to be washed by the washing liquid. As illustrated in FIG. 1, the wash arm may be provided with several spray nozzles 13 for spraying the washing liquid into the washing chamber 3 to wash the items 2 to be washed by the washing liquid.

According to the embodiments illustrated in FIG. 1, the movement of the arm 7 is a rotational movement and the arm 7 is arranged to rotate around an arm rotation axle r. However, according to some embodiments, the movement of arm 7 may be a linear movement of the arm 7, such as a back and forth movement along the rack 5.

The arm moving arrangement 9 may comprise a motor 15, such as an electric motor, arranged to move the arm 7. Thereby, the movement of the arm 7 may be controlled in a simple and predetermined manner to ensure an effective removing of the washing liquid from the rack 5 using the at least one washing liquid removing element 11. In addition, the arm 7 can be moved during the drying phase of the dishwasher 1 without need for water to be sprayed through the spray nozzles 13. According to further embodiments, the arm moving arrangement 9 may comprise an air pump and ducts, where the air pump is connected to the at least one spray nozzle 13, or other apertures, of the arm 7 via the ducts, and wherein the air pump is arranged to pump air to at least one spray nozzle 13, or other apertures, to move the arm 7 using air flowing through the at least one spray nozzle 13, or other apertures, of the arm 7.

According to some embodiments, the at least one washing liquid removing element 11 is resilient. Thereby, the at least one washing liquid removing element 11 will touch at least one of the rack 5 and washing liquid at the rack 5 in a smooth manner upon movement of the arm 7. Thereby, the touching will produce less noise. According to the embodiments illustrated in FIG. 1, the washing liquid removing element 11 is formed as an elongated rod or pin. In further embodiments, the washing liquid removing element 11 may be formed as a brush. The washing liquid removing element 11 may comprise an elastic material such as a polymer or an elastomer. The washing liquid removing element 11 may further comprise a metallic material.

The arm moving arrangement 9 may be arranged to move the arm 7 during at least a drying phase of the dishwasher 1. Thus, the washing liquid may be removed from the rack 5, and/or from the items 2 to be washed, in a simple and efficient manner during the drying phase of the dishwasher 1, which will shorten the drying process of the dishwasher.

According to some embodiments, the at least one washing liquid removing element 11 is arranged to touch at least one of the rack 5 and the washing liquid at the rack 5 only during the drying phase. In such embodiments, the at least one washing liquid removing element 11 is arranged not to touch at least one of the rack 5 and the washing liquid at the rack 5 during a washing phase of the dishwasher 1. Thereby, existence of resistance forces between the at least one washing liquid removing element 11 and the rack 5 can be circumvented during the washing phase and noise during the washing phase may be kept low in a simple manner.

According to some embodiments, the arm 7 is a wash arm and the arm moving arrangement 9 is arranged to move the arm 7 in a first direction d1 during a washing phase of the dishwasher 1, and in a second direction d2 during a drying phase of the dishwasher 1, wherein the first direction d1 is opposite to the second direction d2. FIG. 2.1 and FIG. 2.2 illustrate a respective cross section of the rack 5, the arm 7 and the washing liquid removing element 11 of the dishwasher illustrated in FIG. 1. In FIG. 2.1 the arm 7 is illustrated as being moved in the second direction d2 by the arm moving arrangement. As can be seen, in the embodiments illustrated, the washing liquid removing element 11 is arranged to touch the rack 5 upon movement of the arm 7 in the second direction d2.

In FIG. 2.2, the arm 7 is illustrated as being moved in the first direction d1 by the arm moving arrangement. As can be seen, the washing liquid removing element 11 has been displaced during the movement of the arm 7 in the first direction d1. Thereby, the washing liquid removing element 11 will cease from touching at least one of the rack 5 and the washing liquid at the rack 5.

Accordingly, the arm moving arrangement may move the arm 7 in the second direction d2 during the drying phase of the dishwasher. As a result, washing liquid will effectively be removed from the rack 5 since the washing liquid removing element 11 is arranged to touch the rack 5 upon movement of the arm 7 in the second direction d2.

Further, the arm moving arrangement may move the arm 7 in the first direction d1 during a washing phase of the dishwasher. As a result, resistance forces between the washing liquid removing element 11 and the rack 5 can be eliminated, and noise caused by the washing liquid removing element 11 touching at least one of the rack 5 and the washing liquid at the rack 5 can be circumvented in a simple manner.

Thus, these functions and advantages can be achieved simply by moving the arm 7 in the first direction d1 and in the second direction d2.

According to some embodiments, the arm moving arrangement is arranged to move the arm 7 at a first velocity v1 during a washing phase and at a second velocity v2 during a drying phase of the dishwasher 1, wherein the first velocity v1 is higher than the second velocity v2.

In FIG. 2.1, the arm 7 is also illustrated as being moved at the second velocity v2 by the arm moving arrangement. As can be seen, in the embodiments illustrated, the washing liquid removing element 11 is arranged to touch the rack 5 upon movement of the arm 7 at the second velocity v2.

In FIG. 2.2, the arm 7 is also illustrated as being moved at the first velocity v1 by the arm moving arrangement. As can be seen, the washing liquid removing element 11 has been displaced during movement of the arm 7 at the first velocity v1. Thereby, the washing liquid removing element 11 will cease from touching at least one of the rack 5 and the washing liquid at the rack 5 upon being displaced during movement of the arm 7 at the first velocity v1.

Accordingly, the arm moving arrangement may move the arm 7 at the second velocity v2 during the drying phase of the dishwasher. As a result, washing liquid will effectively be removed from the rack 5 since the washing liquid removing element 11 is arranged to touch the rack 5 upon movement of the arm 7 at the second velocity v2

Further, the arm moving arrangement may move the arm 7 at the first velocity v1 during a washing phase of the dishwasher. As a result, resistance forces between the washing liquid removing element 11 and the rack 5 can be eliminated and noise caused by the washing liquid removing element 11 touching at least one of the rack 5 and the washing liquid at the rack 5 can be circumvented in a simple manner.

Thus, these functions and advantages can be achieved simply by moving the arm 7 at the first velocity v1 and at the second velocity v2.

According to some embodiments, the washing liquid removing element 11 is deformed during movement of the arm in the first direction d1, and/or at the first velocity v1, to cease from touching at least one of the rack 5 and the washing liquid at the rack 5. Such deformation may encompass a bending of the washing liquid removing element 11.

The washing liquid removing element 11 may be deformed and/or displaced during movement of the arm 7 in the first direction d1 and/or at the first velocity v1 by resistance forces caused by air and/or washing liquid within the washing chamber, as well as centrifugal forces acting on the washing liquid removing element 11 during movement of the arm 7 in the first direction d1 and/or at the first velocity v1.

According to some embodiments, as illustrated in FIG. 2.1 and FIG. 2.2, the arm 7 comprises a guiding element 10, wherein the washing liquid removing element 11 is connected to the arm 7 via the guiding element 10. In the embodiments illustrated, the guiding element 10 biases the washing liquid removing element 11 towards a position where the washing liquid removing element 11 touches at least one of the rack 5 and the washing liquid at the rack 5, below referred to as the touching position. The biasing force is in a direction essentially coinciding with the first direction d1. The guiding element 10 is arranged to prevent displacement of the washing liquid removing element 11 past the touching position in the first direction d1. Upon movement of the arm 7 in the second direction d2, as is illustrated in FIG. 2.1, resistance forces caused by air and/or washing liquid within the washing chamber will apply a force onto the washing liquid removing element 11 in the first direction d1. The resistance forces and the biasing force thus acts in the first direction d1 upon movement of the arm 7 in the second direction d2. Since the guiding element 10 is arranged to prevent displacement past the touching position in the first direction d1, the washing liquid removing element 11 will assume the touching position upon movement of the arm 7 in the second direction d2. Such touching position is illustrated in FIG. 2.1.

Upon movement of the arm 7 in the first direction d1, as is illustrated in FIG. 2.2, resistance forces caused by air and/or washing liquid within the washing chamber will apply a force onto the washing liquid removing element 11 in the second direction d2. The guiding element 10 is arranged to bias the washing liquid removing element 11 with a biasing force less than the resistance forces applied to washing liquid removing element 11 upon movement of the arm 7 in the first direction d1. As a result, upon movement of the arm 7 in the first direction d1, the resistance forces will displace the washing liquid removing element 11 to a position where the washing liquid removing element 11 ceases from touching at least one of the rack 5 and the washing liquid at the rack 5. Such a position is illustrated in FIG. 2.2.

As referred to above, FIG. 2.1 also illustrates the arm 7 as being moved at the second velocity v2, and FIG. 2.2 also illustrates the arm 7 is as being moved at the first velocity v1 by the arm moving arrangement, wherein the first velocity v1 is higher than the second velocity v2. Also in these embodiments, the guiding element 10 biases the washing liquid removing element 11 towards a position where the washing liquid removing element 11 touches at least one of the rack 5 and the washing liquid at the rack 5. The biasing force is in a direction coinciding with a direction of movement of the arm 7 at the first velocity v1 and the second velocity v2. Upon movement of the arm 7 at the first velocity v1 and at the second velocity v2, resistance forces caused by air and/or washing liquid within the washing chamber will apply a force onto the washing liquid removing element 11 in a direction opposite to the direction of movement. The biasing force and the second velocity v2 are configured such that the biasing force is greater than the resistance forces upon movement of the arm 7 at the second velocity v2. As a result, upon movement of the arm 7 at the second velocity v2, the washing liquid removing arrangement 11 will assume the position where the washing liquid removing element 11 touches at least one of the rack 5 and the washing liquid at the rack 5. Such position is illustrated in FIG. 2.1.

The biasing force and the first velocity v1 are configured such that the biasing force is less than the resistance forces upon movement of the arm 7 at the first velocity v1. As a result, upon movement of the arm 7 at the first velocity v1, the washing liquid removing arrangement 11 will assume the position where the washing liquid removing element 11 ceases from touching at least one of the rack 5 and the washing liquid at the rack 5. Such position is illustrated in FIG. 2.2.

In addition to resistance forces caused by air and/or washing liquid within the washing chamber, centrifugal forces will also apply a force onto the washing liquid removing element 11 upon movement of the arm 7 in the first direction d1, the second direction d2 as well as upon movement of the arm 7 at the first velocity v1 and the second velocity v2. The guiding element 10 may thus be arranged to guide the washing liquid removing element 11 in a manner corresponding to the above described, also based on centrifugal forces acting on the washing liquid removing element 11.

According to some embodiments, the guiding element 10 is arranged to displace the washing liquid removing element 11 in a direction out from the arm 7, upon movement of the arm 7 in the second direction d2, and/or at the second velocity v2, to a position where the washing liquid removing element 11 touches at least one of the rack 5 and the washing liquid at the rack 5. And further, according to some embodiments, the guiding element 10 is arranged to displace the washing liquid removing element 11 in a direction towards the arm 7, upon movement of the arm 7 in the first direction d1 and/or at the first velocity v1, to a position where the washing liquid removing element 11 ceases from touching at least one of the rack 5 and the washing liquid at the rack 5.

The dishwasher 1 may comprise a control unit arranged to control the arm moving arrangement 9 to move the arm 7 in the first direction d1 during the washing phase and in the second direction d2 during the drying phase. Such control unit may, according to some embodiments, be arranged to control the arm moving arrangement 9 to move the arm 7 at the first velocity v1 during the washing phase and at the second velocity v2 during the drying phase.

The washing liquid removing element 11 may comprise a non-absorbing material such as rubber, silicon, thermoplastic elastomer (TPE), metal or the like. As a result, the at least one washing liquid removing element 11 will wipe the washing liquid from the rack 5, rather than absorbing it.

According to the embodiments illustrated in FIG. 1, the arm 7 comprises a plurality of washing liquid removing elements 11 arranged to touch at least one of the rack 5 and the washing liquid at the rack 5 upon movement of the arm 7 to remove washing liquid from the rack 5. Each of the washing liquid removing elements 11 may be formed as an elongated solid- or hollow rod with for example a circular cross-section.

As illustrated in FIG. 1, the dishwasher 1 may comprise a second rack 17 adapted to accommodate items to be washed by washing liquid within the washing chamber 3. Further, the dishwasher 1 may comprise a second arm 19, and a second arm moving arrangement 21 arranged to move the second arm 19 within the washing chamber 3.

The second arm 19 may comprise at least one second washing liquid removing element 23 arranged to touch at least one of the second rack 17 and washing liquid at the second rack 17 upon movement of the second arm 19 to remove the washing liquid from the second rack 17. The second rack 17, the second arm 19, the second arm moving arrangement 21 and the at least one second washing liquid removing element 23 may correspond to embodiments of the rack 5, the arm 7, the arm moving arrangement 9 and the at least one washing liquid removing element 11, as described above.

Figure 3:
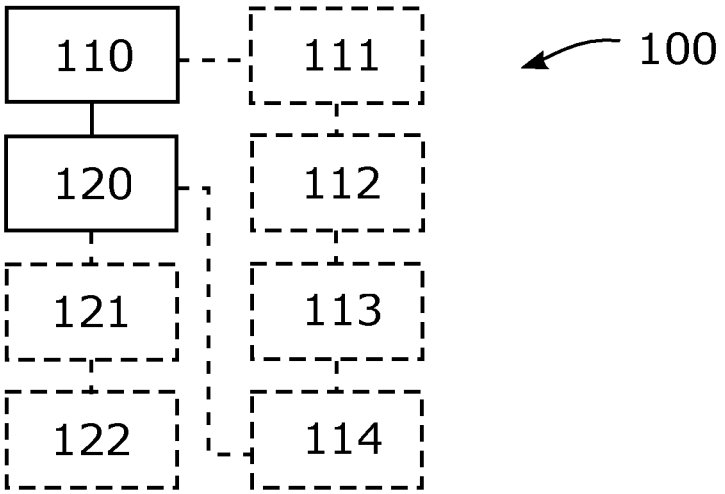
FIG. 3 illustrates a method for removing washing liquid from a rack of a dishwasher according to some embodiments.

FIG. 3 illustrates a method 100 for removing washing liquid from a rack of a dishwasher comprising a washing chamber, a rack adapted to accommodate items to be washed by washing liquid within the washing chamber, an arm and an arm moving arrangement, wherein the arm comprises at least one washing liquid removing element, and where the method 100 comprises:

moving 110 the arm within the washing chamber, using the arm moving arrangement, and removing 120 washing liquid from the rack by touching at least one of the rack and washing liquid at the rack upon the movement of the arm, using the at least one washing liquid removing element.

As illustrated in FIG. 3, the method 100 may comprise:

moving 111 the arm in a first direction during a washing phase of the dishwasher, using the arm moving arrangement, wherein the at least one washing liquid removing element is arranged to be at least one of deformed and displaced during movement of the arm in the first direction, and wherein the at least one washing liquid removing element is arranged to cease from touching at least one of the rack and the washing liquid at the rack upon being at least one of deformed and displaced during movement of the arm in the first direction, moving 112 the arm in a second direction during a drying phase of the dishwasher, using the arm moving arrangement, wherein the first direction is opposite to the second direction, and removing 121 the washing liquid from the rack by touching at least one of the rack and washing liquid at the rack upon movement of the arm in the second direction.

As illustrated in FIG. 3, the method 100 may comprise:

moving 113 the arm at a first velocity during a washing phase of the dishwasher, using the arm moving arrangement, wherein the at least one washing liquid removing element is arranged to be at least one of deformed and displaced during movement of the arm at the first velocity, and wherein the at least one washing liquid removing element is arranged to cease from touching at least one of the rack and the washing liquid at the rack upon being at least one of deformed and displaced during movement of the arm at the first velocity, moving 114 the arm at a second velocity during a drying phase of the dishwasher, using the arm moving arrangement, wherein the first velocity is higher than the second velocity, and removing 122 the washing liquid from the rack by touching at least one of the rack and washing liquid at the rack upon movement of the arm at the second velocity.

The invention claimed is:

1. A dishwasher comprising a washing chamber, a rack adapted to accommodate items to be washed by washing liquid within said washing chamber, an arm, and an arm moving arrangement arranged to move said arm within said washing chamber, wherein said arm comprises at least one washing liquid removing element arranged to touch at least one of said rack and washing liquid at said rack upon movement of said arm to remove said washing liquid from said rack.

2. The dishwasher according to claim 1, wherein said arm is a wash arm provided with at least one spray nozzle for spraying washing liquid into said washing chamber to wash said items to be washed by said washing liquid.

3. The dishwasher according to claim 1, wherein said movement is a rotational movement.

4. The dishwasher according to claim 1, wherein said arm moving arrangement comprises a motor arranged to move said arm.

5. The dishwasher according to claim 1, wherein said at least one washing liquid removing element is resilient.

6. The dishwasher according to claim 1, wherein said arm moving arrangement is arranged to move said arm during at least a drying phase of said dishwasher.

7. The dishwasher according to claim 6, wherein said at least one washing liquid removing element is arranged to touch at least one of said rack and said washing liquid at said rack only during said drying phase.

8. The dishwasher according to claim 1, wherein said arm is a wash arm, and wherein said arm moving arrangement is arranged to move said arm in a first direction (d1) during a washing phase, and in a second direction (d2) during a drying phase of said dishwasher, wherein said first direction (d1) is opposite to said second direction (d2), and wherein said at least one washing liquid removing element is arranged to touch at least one of said rack and said washing liquid at said rack upon movement of said arm in said second direction (d2), and wherein said at least one washing liquid removing element is arranged to be at least one of deformed and displaced during movement of said arm in said first direction (d1), and is arranged to cease from touching at least one of said rack and said washing liquid at said rack upon being at least one of deformed and displaced during movement of said arm in said first direction (d1).

9. The dishwasher according to claim 1, wherein said arm is a wash arm, and wherein said arm moving arrangement is arranged to move said arm at a first velocity (v1) during a washing phase, and at a second velocity (v2) during a drying phase of said dishwasher, wherein said first velocity (v1) is higher than said second velocity (v2), and wherein said at least one washing liquid removing element is arranged to touch at least one of said rack and said washing liquid at said rack upon movement of said arm at said second velocity (v2), and wherein said at least one washing liquid removing element is arranged to be at least one of deformed and displaced during movement of said arm at said first velocity (v1), and is arranged to cease from touching at least one of said rack and said washing liquid at said rack upon being at least one of deformed and displaced during movement of said arm at said first velocity (v1).

10. The dishwasher according to claim 1, wherein said at least one washing liquid removing element comprises a non-absorbing material.

11. The dishwasher according to claim 1, wherein said arm comprises a plurality of washing liquid removing elements arranged to touch at least one of said rack and said washing liquid at said rack upon movement of said arm to remove washing liquid from said rack.

12. A method for removing washing liquid from a rack of a dishwasher comprising a washing chamber, a rack adapted to accommodate items to be washed by washing liquid within said washing chamber, an arm and an arm moving arrangement, wherein said arm comprises at least one washing liquid removing element and wherein said method comprises:

moving said arm within said washing chamber, using said arm moving arrangement, and removing washing liquid from said rack by touching at least one of said rack and washing liquid at said rack upon said movement of said arm, using said at least one washing liquid removing element.

13. The method according to claim 12, wherein said arm is a wash arm and wherein said method comprises:

moving said arm in a first direction (d1) during a washing phase of said dishwasher, using said arm moving arrangement, wherein said at least one washing liquid removing element is arranged to be at least one of deformed and displaced during movement of said arm in said first direction (d1), and wherein said at least one washing liquid removing element is arranged to cease from touching at least one of said rack and said washing liquid at said rack upon being at least one of deformed and displaced during movement of said arm in said first direction (d1), moving said arm in a second direction (d2) during a drying phase of said dishwasher, using said arm moving arrangement, wherein said first direction (d1) is opposite to said second direction (d2), and removing said washing liquid from said rack by touching at least one of said rack and washing liquid at said rack upon movement of said arm in said second direction (d2).

14. The method according to claim 12, wherein said arm is a wash arm and wherein said method comprises:

moving said arm at a first velocity (v1) during a washing phase of said dishwasher, using said arm moving arrangement, wherein said at least one washing liquid removing element is arranged to be at least one of deformed and displaced during movement of said arm at said first velocity (v1), and wherein said at least one washing liquid removing element is arranged to cease from touching at least one of said rack and said washing liquid at said rack upon being at least one of deformed and displaced during movement of said arm at said first velocity (v1), moving said arm at a second velocity (v2) during a drying phase of said dishwasher, using said arm moving arrangement, wherein said first velocity (v1) is higher than said second velocity (v2), and removing said washing liquid from said rack by touching at least one of said rack and washing liquid at said rack upon movement of said arm at said second velocity (v2).

* * * * *